US005505338A

United States Patent [19]

Gueret

[11] Patent Number: 5,505,338

[45] Date of Patent: Apr. 9, 1996

[54] PRODUCT DISPENSER WITH DEFORMABLE BAG

[75] Inventor: Jean-Louis H. Gueret, Paris, France

[73] Assignee: L'Oreal, Paris, France

[21] Appl. No.: 477,319

[22] Filed: Jun. 7, 1995

Related U.S. Application Data

[62] Division of Ser. No. 157,172, Dec. 7, 1993.

[30] Foreign Application Priority Data

Apr. 30, 1992 [FR] France ..... 92 05377

[51] Int. Cl.[6] ..... B65D 35/28

[52] U.S. Cl. ..... 222/95; 222/107; 383/107

[58] Field of Search ..... 222/107, 321.1, 222/321.7, 95; 383/107, 121, 108; 220/662, 445, 403

[56] References Cited

U.S. PATENT DOCUMENTS

| | | | |
|---|---|---|---|
| 3,662,926 | 5/1972 | Umstead | 222/95 |
| 4,189,069 | 2/1980 | Stoody | 222/83.5 |
| 5,031,384 | 7/1991 | Rebeyrolle et al. | 53/452 |
| 5,078,509 | 1/1992 | Center et al. | 383/88 |
| 5,139,168 | 8/1992 | Gueret | 222/92 |
| 5,161,718 | 11/1992 | Gueret | 222/212 |

FOREIGN PATENT DOCUMENTS

| | | |
|---|---|---|
| 0444982 | 9/1991 | European Pat. Off. . |
| 0452196 | 10/1991 | European Pat. Off. . |
| 2648794 | 12/1990 | France . |
| 2233396 | 1/1991 | United Kingdom . |

*Primary Examiner*—Andres Kashnikow
*Assistant Examiner*—Lisa Douglas
*Attorney, Agent, or Firm*—Young & Thompson

[57] ABSTRACT

The product dispenser (1) comprises a container (4) inside which is located a bag (2) made from a deformable plastic compound; a base (7) carrying the dispensing member (8) is mechanically held with respect to the container (4), a bottom end of the bag (2) being welded along a band (33). The bag (2) is formed from a sheath obtained by welding, along at least one longitudinal band (32), the longitudinal edges of a strip. The longitudinal band of weld (32) welds an inner face of a longitudinal edge of the strip, from which the bag (2) is formed, to the inner face of the other longitudinal edge of the strip situated on the same side of the strip as the previous face. The base (7) includes a weld surface (10), and the welded assembly of the two longitudinal edges of the strip is folded back against the outer surface of the sheath and welded in this position by the weld for welding the end of the bag (2) onto the weld surface (10) of the base.

4 Claims, 4 Drawing Sheets

PRODUCT DISPENSER WITH DEFORMABLE BAG

This application is a division of application Ser. No. 08/157,172, filed Dec. 7, 1993, pending.

FIELD OF THE INVENTION

The subject of the present invention is a liquid to pasty product dispenser with a deformable bag. More precisely, it relates to a dispenser comprising a container inside which is located a bag made from an easily deformable plastic compound, without an air intake. A base carrying a dispensing member is generally held mechanically with respect to the container. The constituent material of the bag must be very flexible and of a very small thickness so as to have a very small extent of shape memory to allow the bag to be emptied totally even when the dispensing member comprises a hand pump which, as is known, works better the smaller the depression in the bag, the bag being one without an air intake when, in particular, the products contained in the bag are sensitive to air; this is the case, for example, with cosmetic products.

BACKGROUND OF THE INVENTION

FR-A-2,648,794 discloses such a dispenser of the sort in which the said bag is formed from a sheath obtained by welding, along at least one longitudinal band, the longitudinal edges of a strip, the peripheral length of the cross section of the sheath being substantially equal to the peripheral length of the base, the said longitudinal band of weld intersecting a band of weld at the bottom end in a region which is distinct from the ends of the said band of weld at the bottom end. The bag is fixed to the base by crimping which presents the risk of damaging the relatively fragile plastic compound, particularly when its thickness is small so that it is easily deformable. Furthermore, sealing at the level of this fixing by crimping needs to be improved.

U.S. Pat. No. 3,662,926 discloses a dispenser with a deformable bag produced from a flexible tube which does not have a longitudinal band of weld. The bag is fixed by welding onto the base. The welding poses no major problem in this case because the bag is not made from a plastic compound and does not include a longitudinal band of weld, which would constitute an excess thickness.

SUMMARY OF THE INVENTION

The invention aims to produce a dispenser in which the product is particularly sheltered from the air, it being necessary for this dispenser to enable practically the whole bag to be emptied. The material of the bag must therefore be particularly airtight, which may be obtained by employing a compound multi-layer material. The securing of the bag to the base must also be-completely airtight. It is furthermore desirable for the manufacture to remain simple and reliable.

The subject of the present invention is therefore a liquid to pasty product dispenser comprising a container inside which is located a bag made from an easily deformable plastic compound, without an air intake, a base carrying the dispensing member being mechanically held with respect to the container, a bottom end of the said bag being welded along a band, in which dispenser the said bag is formed from a sheath obtained by welding, along at least one longitudinal band, the longitudinal edges of a strip, the peripheral length of the cross section of the sheath being equal to the peripheral length of the base, the said longitudinal band of weld intersecting the said band of weld at the bottom end in a zone which is distinct from the ends of the said band of weld at the bottom end, characterized in that:

the longitudinal band of weld welds an inner face of a longitudinal edge of the strip to the inner face of the other longitudinal edge of the strip, the welded faces being situated on the same side of the strip, the base includes a weld surface, and the welded assembly of the two longitudinal edges of the strip is folded back against the outer surface of the sheath and welded in this position by the weld for welding the end of the bag onto the weld surface of the base.

Preferably, the weld surface at all points has a radius of curvature greater than 0.5 mm.

The strip from which the said bag is formed may have a thickness of between 20 and 200 microns.

Advantageously, the bag is made from a compound material consisting of at least three layers, amongst which there is an internal layer welded directly onto the weld surface of the base and an external layer intended for the mechanical protection of the bag.

The internal layer and/or the external layer is made from a material of the group formed by polyethylene, polyethylene terephthalate, polyvinylchloride, polypropylene, polyacrylonitrile, polyamide, polyester.

The intermediate layer, located between the external layer and the internal layer, is made from a material of the group formed by poly(ethylene/vinylacetate)chloride, poly(ethylene/vinylalcohol), polyacrylonitrile, aluminum, polyamide.

Preferably, the material of the internal layer has a lower melting point than that of the material of the external layer.

Advantageously, the outer layer is made from a material of the group formed by polyester, polyethylene terephthatate, ceramic polyester, metallized polyester, particularly aluminized polyester. On the inner side, this external layer includes a film, acting as an adhesive, made from a material of the polyurethane, polyethylene, polyvinylchloride group. The melting point of the external layer is situated substantially between 220° C. and 280° C.

Preferably, the internal layer is made from a material of the group formed by polyethylene, polyethylene containing filled Zeolites of asepticizing products and/or preserving agents. The melting point of the internal layer is situated substantially between 180° C. and 200° C.

The assembly of the two welded longitudinal edges, which is folded back against the outer surface of the sheath, may be welded in this position by the band of weld at the bottom end of the bag.

Advantageously, the longitudinal band of weld of the bag is located in the region of the weld surface of the base where the radius of curvature is maximum.

The band of weld at the bottom end may be rectilinear, or as a broken or curved line.

Preferably, the base includes stop means interacting with the upper rim of the container.

The container may be made from a rigid material and includes an air intake orifice.

According to another possibility, the container is made from a flexible memory material and is associated with a valve located in such a sense that the air present in the container is compressed when an action is exerted on the container for the purpose of dispensing the product contained inside the bag.

The container may be made from transparent material and may be associated with a screen located inside the container outside the bag, said screen concealing the said bag.

The container may be welded onto the base in line with a weld surface which is located above the surface via which the bag is welded onto the base.

The container may receive, at its end opposite the one which receives the base, an end which is secured to the container by welding or bonding.

The dispensing member may be a diaphragm pump, a needle valve or a hand pump.

The base and the container may carry indexing means making it possible to position the base with respect to the container.

Advantageously, the base includes an anti-trapping device; the anti-trapping device can be traversed by a hollow filling needle.

BRIEF DESCRIPTION OF THE DRAWINGS

To make the subject of the invention easier to understand some embodiments thereof in the appended drawings will now be described by way of purely illustrative and non-limiting example.

In these drawings.

DETAILED DESCRIPTION OF THE INVENTION

Figure 1:
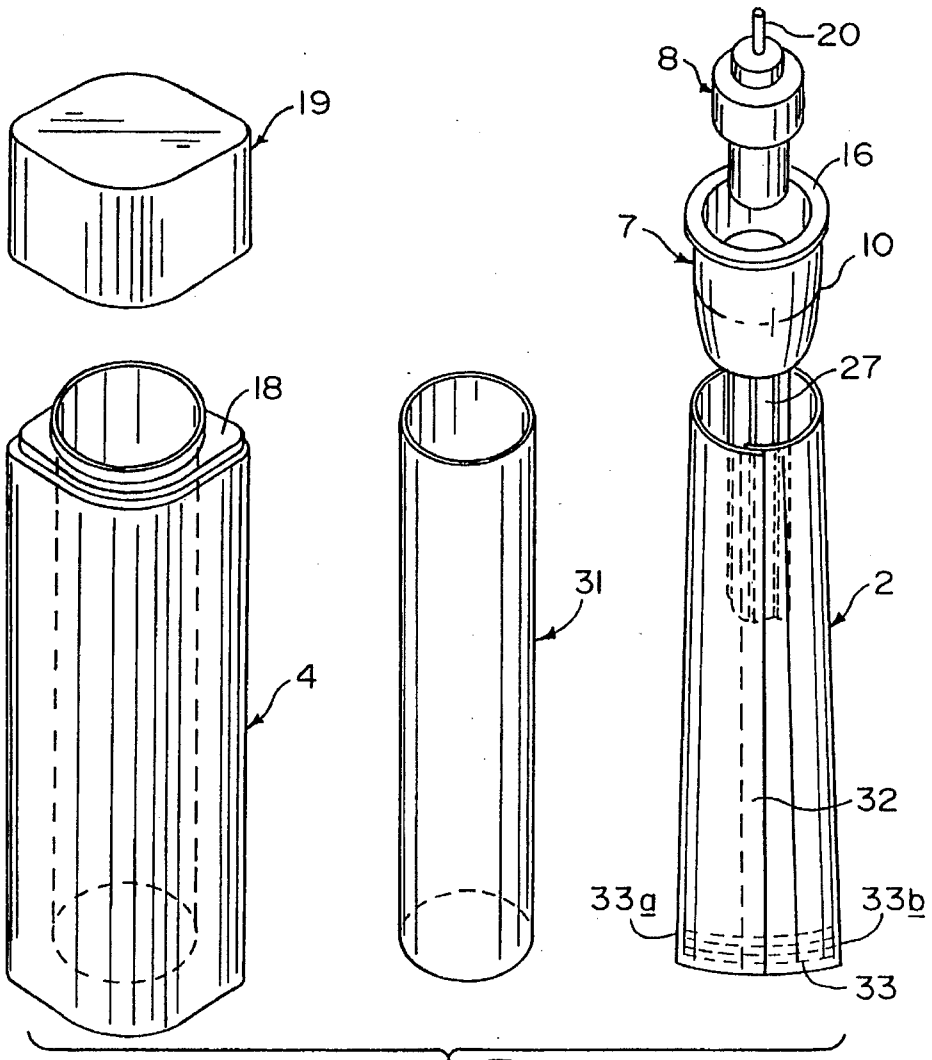
FIG. 1 is an exploded view of a dispenser according to the invention, showing its various constituent components.
Figure 3:
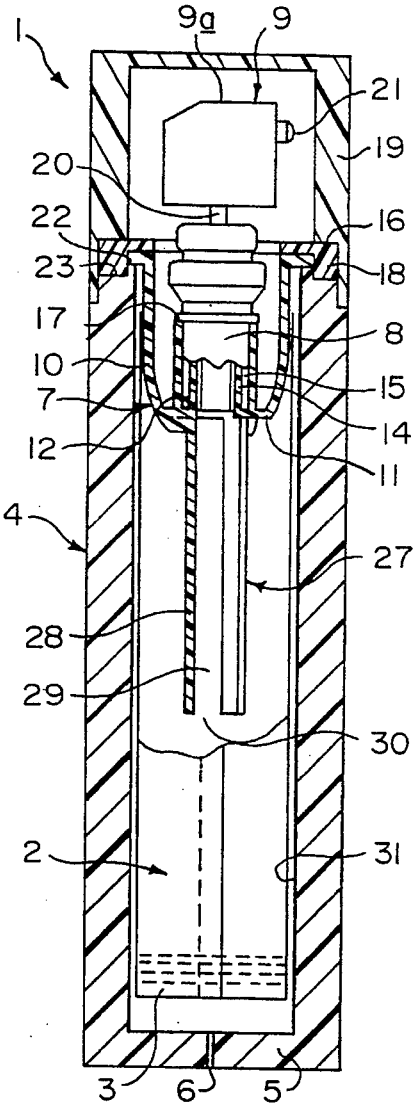
FIG. 3 is a section of the dispenser, assembled, of FIG. 1.

Referring to FIGS. 1 and 3 of the drawings, there can be seen a liquid to pasty product dispenser 1 which comprises a deformable flexible bag 2. The bag 2 is secured, at the top, through the use of a base 7, to a rigid outer container 4, of cylindrical shape, the transverse section of which may have a shape other than the circular shape, for example an oval shape. The container 4 is equipped with a bottom 5 including an orifice 6 to establish communication with the atmosphere. A hand pump 8, without air intake, surmounted by a push button 9, is fixed onto the base 7 which has the shape of a dish. More precisely, the dish 7 is equipped, on its outer wall, with the weld surface 10 onto which the upper part of the bag 2 is engaged, which upper part is fixed to the wall of the base by welding along the weld surface 10. The base 7 has its concavity pointing to the side opposite the bag 2.

A sleeve 12 is formed in the central zone of the bottom 11 of the base, as well as a sleeve tube 14; the sleeve 12 and the sleeve tube 14 project from that side of the bottom 11 which points towards the pump 8, between them defining an annular space in which is positioned an annular stem 15 which carries the pump 8 which, moreover, has a collar 17 for bearing on the upper edge of the sleeve 12; in this position, the pump is secured to the base 7 by bonding; in a variant which is not represented this securing is obtained by snap fitting.

A rod 20 projects, upwards, relative to the pump body 8. The push button internally includes a bore capable of receiving the end of the rod 20 and a pipe for establishing communication with the atmosphere through a dispensing nozzle 21. The rod 20 may be driven into the pump body and actuate a piston when pressure is exerted on the push button 9, return being provided by a spring located inside the pump body.

Towards its upper end, the base 7 is equipped with a collar 16 capable of interacting with a rim 22 provided at the upper part of the container 4. A retaining ring 18, equipped in its central region with an opening for the passage of the pump body 8 covers over the collar 16 of the base 7 and is secured to the container by bonding of its transverse end face 23; this securing by bonding may, of course, be replaced by any other type of securing, for example by clipping.

The bottom 11 of the dish 7 carries anti-trapping members 27 the function of which, known per se, is to prevent the walls of the flexible bag 2 from bonding against one another, for example in their middle region, and from trapping a volume of product, which will not be able to be ejected, in the lower part. The anti-trapping members advantageously consist of fins 28 placed around the axis of the container and extending longitudinally towards the bottom from the opening in which the base of the pump body 8 is engaged; the border of each fin close to the axis includes a hollowing 29 leaving a passage for the product; the fins 28 are advantageously formed by molding integrally with the dish 7; of course, it is possible to envisage any anti-trapping device whatsoever formed integrally by molding with the bottom 11 of the dish, for example a grid or a perforated tube. Preferably, the lower part 30 of the anti-trapping members 27 is free, to allow the passage of a hollow needle for filling the bag 2 before the pump 8 is installed, when the bag 2 is filled from above after it has been entirely produced; of course, it is preferable, in this case, for the pump 8 to be secured to the base 7 by snap fitting.

In the example represented in FIGS. 1 and 3, the container 4 is made from transparent material; a screen 31, made as a tube cut from a sheath obtained by extrusion, is located in the container 4 and surrounds the bag 2, concealing it; the screen 31 carries any desired marking and/or any desired decoration. The screen 31 may be opaque or translucent; its wall may advantageously, to obtain decorative effects, be corrugated, or have longitudinal ribs, for example. The constituent material of the screen 31 may be any whatsoever, because the screen is not in contact with the product: it is advantageously chosen so that it is biodegradable.

Figure 4:
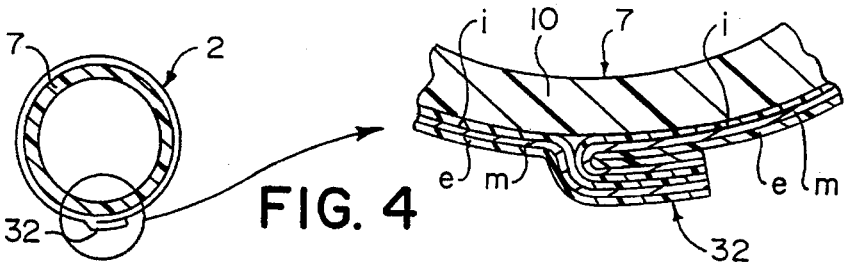
FIG. 4 is a simplified diagrammatic transverse section of the bag and of the base along the line IV—IV of FIG. 2, with a magnifying glass on the band of weld.

According to the present invention, the bag 2, represented in FIGS. 1, 3 and 4, is made from a compound material consisting of three layers; the internal layer i and the external layer e are made from a material chosen from the group formed by polyethylene, polyethylene terephthalate, polyvinylchloride, polypropylene, polyacrylonitrile, polyamide and polyester. The intermediate layer m is made from a material chosen from the group formed by poly(ethylene/ vinylacetate)chloride, poly(ethylene/vinylalcohol),polyacrylonitrile, aluminum, and a polyamide. These materials are, in effect, chosen so that the compound material has great flexibility to allow easy operation of the pump and a very small extent of shape memory to facilitate complete emptying of the bag; this also assumes that the compound material has a small thickness: the latter does not exceed, moreover, 2/10mm, whilst being greater than 20 microns. Better results are obtained when this thickness does not exceed 100 microns. The use of a compound material to constitute the bag is dictated by the need for airtightness, on the one hand, and for compatibility with the products which the bag must contain, on the other hand, such as, for example, although without any limitation being implied, cosmetic products. A compound which gave satisfaction consisted of four successive layers respectively of polyethylene terephthalate, polyurethane, aluminum, and polyethylene.

Advantageously, the external layer e is made from a material of the group formed by polyester, polyethylene terephthalate, ceramic polyester, metallized polyester, particularly aluminized polyester. Treated polyesters (atomization of silica for ceramic polyester, or metallization under vacuum for metallized polyester) give very good impermeability to gases (particularly to oxygen) and to water vapour. On the inside, this external layer e includes a film, acting as adhesive, made from a material of the polyurethane, polyethylene or polyvinylchloride group. The melting point of the external layer is situated substantially between 220° C. and 280° C.

The internal layer i is, preferably, made from polyethylene or from polyethylene containing zeolites filled with aseptic-izing products and/or preservative agents. The melting point of the internal layer is situated substantially between 180° and 200° C.

Figure 2:
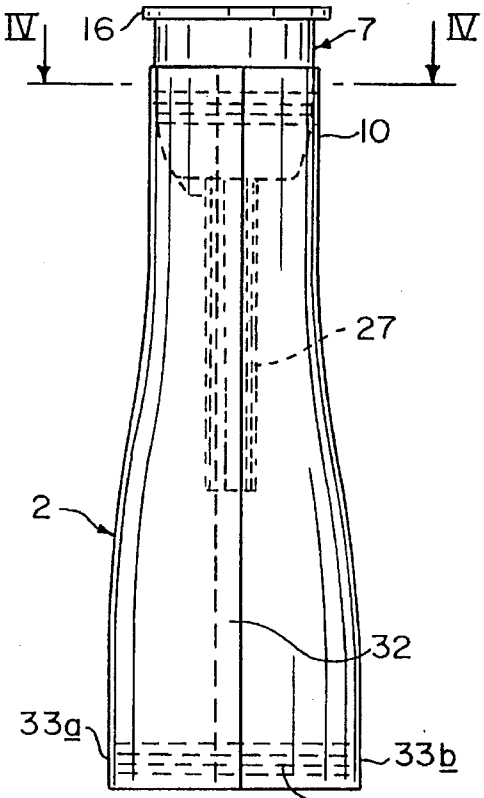
FIG. 2 represents a subassembly of the dispenser according to FIG. 1, showing the bag and the base assembled.

Such a compound material can only be manufactured in the form of a band; consequently, the bag 2 is obtained from a strip in which the two longitudinal edges are welded. In the example represented in FIGS. 2 and 4, which show the subassembly obtained after welding the bag 2 onto the base 7 along the weld surface 10, the bag is formed from a strip in which, in a first instance, the inner faces of two longitudinal edges which are situated on the same side of the strip have been welded to obtain a longitudinal band of weld 32, and to constitute a sheath which is cut to length; in a second instance, the welded band is folded back onto the external surface of the bag, and held, at its ends, in this position, by welding the upper end of the bag 2 onto the weld surface 10 of the base 7.

This operation of welding the upper end of the bag starts by welding the folded back band 32. A heating welding tool, particularly a cutting wheel, presses this folded back band 32 against the external surface of the bag and against the weld surface 10. The external layer e, the melting point of which is higher, may be heated to a temperature sufficient to cause the internal layer i to melt and to give rise to the welding of the surface 10, without this external layer e in any way being traversed by the tool or traversing the internal layer. The weld surface 10, and more generally the base 7, are made from a material which can be welded to the internal layer i; for example the base 7 is made from polypropylene which can be welded with a film of polyethylene.

The upper end of the bag 2 is then welded over the entire periphery of the surface 10.

At its lower end, the folded back band 32 is welded at the same time as the sheath along the transverse band of weld 33 which closes the bag 2 at its lower part.

Advantageously, the folded back band 32 and the band 33 intersect in a portion of the band 33 which is remote from its ends **33*a* and 33*b***.

By virtue of this configuration, the cross section of the bag is entirely contained in the cross section of the container 4, which allows and facilitates the installation of the bag in the container while the bag is already full. This is one of the advantages of the bag according to the invention.

The said bag may, moreover, also be filled from the bottom; the composition and the slight thickness of the compound in effect make it possible to weld the lower end of the bag by pinching the product, present in the sheath, during welding, which ensures that there will not be any air in the closed bag. It is therefore possible to use a machine for filling the bag from the bottom, under vacuum.

When the base is not circular, and therefore when the weld surface 10 is not circular, the band of weld 32 is situated on the weld surface in a zone in which the radius of curvature is maximum; means for indexing the base with respect to the container are provided if this indexing is not obtained automatically by the shape of their cross section.

Figure 5:
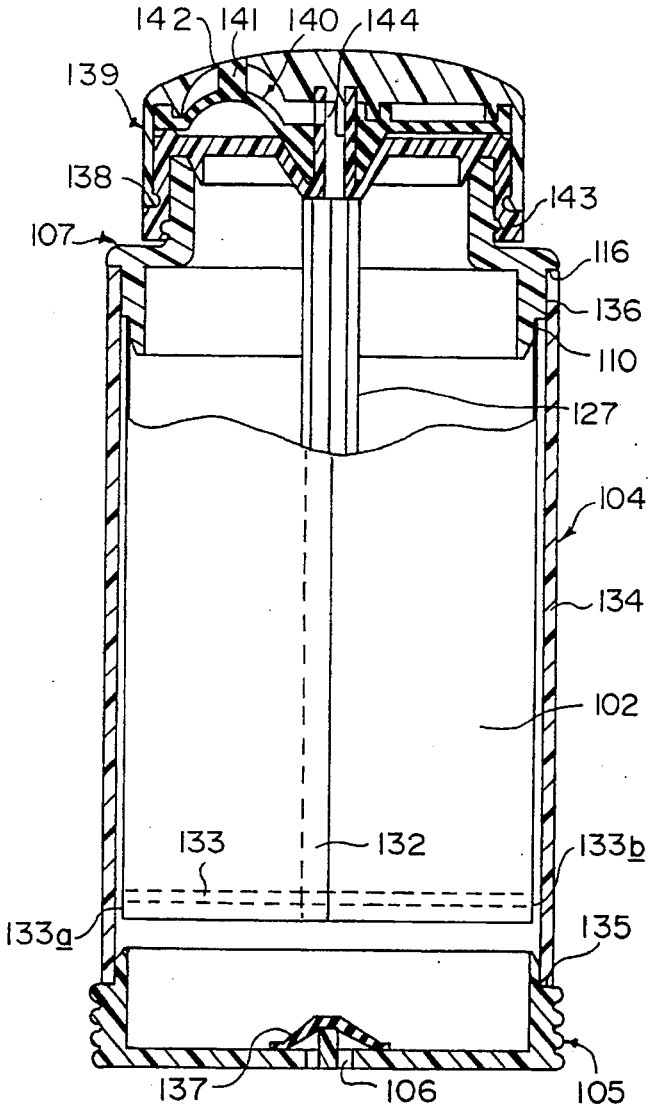
FIG. 5 is a dispenser variant according to the invention, in section.

FIG. 5 shows a dispenser variant according to the invention in which the container 104 consists of a sheath 134 made from flexible material, with shape memory, and obtained by extrusion, and closed at its lower part by a bottom 105 made from rigid plastic; the bottom 105, attached to the sheath in the example represented and secured to the latter for example by bonding or welding the end 135, may have a cross section different from that of the base 107 to which the upper end of the sheath 134 of the container 104 is secured. This securing is obtained by welding the sheath 134 onto a weld surface 136 of the base 107 situated, on the said base, above the surface 110 via which the flexible bag 102 is welded onto the base 107. The constituent material of the sheath 134 may be anything whatsoever; as has already been stated as regards the screen 31 of FIGS. 1 and 3, it is advantageously chosen so that it is biodegradable.

According to this variant, the base 107 has a sleeve tube 138 extending opposite the bag 102, and on which is mounted, by clipping at 143, a dispensing head 139 the dispensing orifice 142 of which is closed, at rest, by a needle valve 141 carried by an elastic diaphragm 140; a passageway 144 in communication with the inside of the bag 102 allows the product to be dispensed through the dispensing orifice 142 when this orifice is freed by the needle valve 141 by the action of the pressure of the product on the diaphragm 140; the product is pressurized by manual action on the flexible container 134 and is allowed by virtue of the presence of a bottom valve 137 interacting with the orifice 106 for communicating with the outside of the volume lying between the bag 102 and the inside of the container 134.

According to a variant which is not represented, the bottom 105 is replaced by a transverse weld at the bottom end of the container 104.

Figure 6:
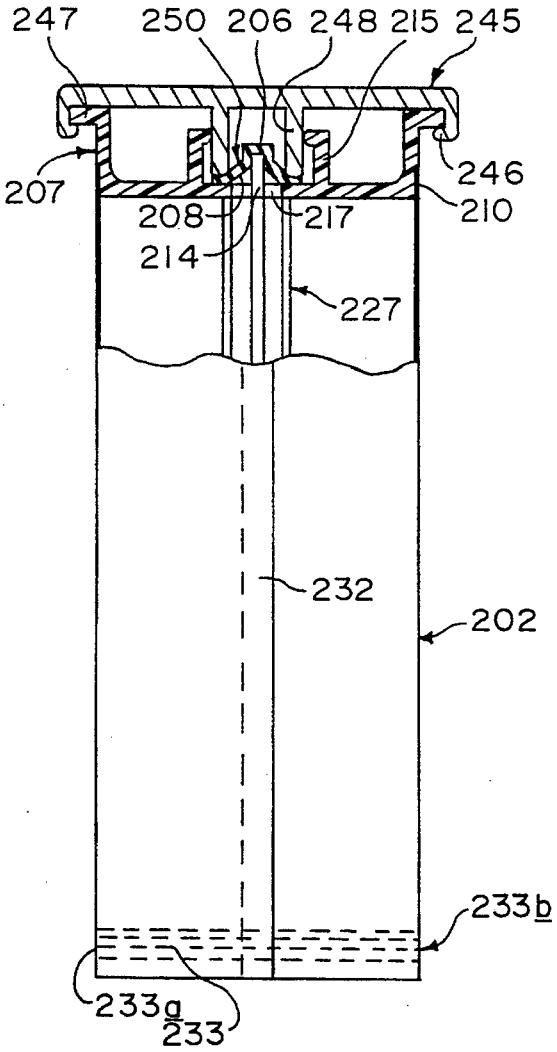
FIG. 6 is a refill for a dispenser according to the invention, partially in section.

FIG. 6 shows a bag 202 which is welded to a rigid base 207; the base 207 is equipped with a spout 215 associated with a partially elastic element 250 to constitute a one-way opening valve; the element 250 includes a part 206 for fastening onto a finger 214 secured to the base 207 and an elastic part 208 in the form of a frustoconical diaphragm bearing elastically against the bottom of the base; openings 217 allow the product to leave the bag when the diaphragm 208 prevents it from doing so, provided that no pressure is exerted on the walls of the bag; a lid 245 has, on the one hand, means 246 for fastening onto a circular rim 247 of the base 207 and, on the other hand, axial tabs 248 extending as far as the periphery of the diaphragm 208, so that when the lid 245 is in place on the base 207 an action is exerted on the periphery of the diaphragm applied to its seat which is constituted by the bottom of the base, thus preventing any product from leaving, even if an action is exerted on the bag 202; this configuration makes it possible to constitute a product refill, which can be stored, the bag remaining filled with product.

Figure 7:
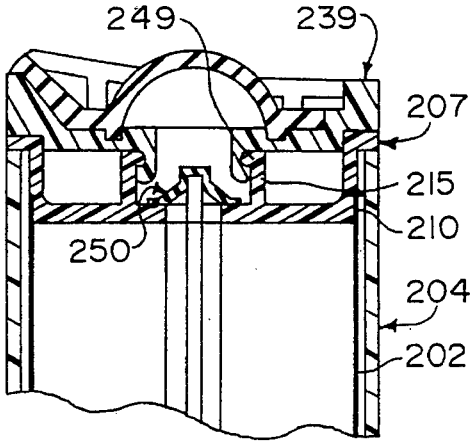
FIG. 7 is a partial axial section of a dispenser variant using the refill according to FIG. 6.

FIG. 7 shows a dispenser employing the refill of FIG. 6; after the lid 245 has been removed from the base 245 [sic], the refill is inserted into a container 204; a diaphragm pump 239, as known per se, is installed on the base 207 on which it is held by virtue of fastening means 249 carried by the spout 215 of the base, the pump itself carrying complementary fastening means. It will be noted that by virtue of this configuration, the product contained in the refill is never put back in contact with air until it is actually used.

Figure 8:
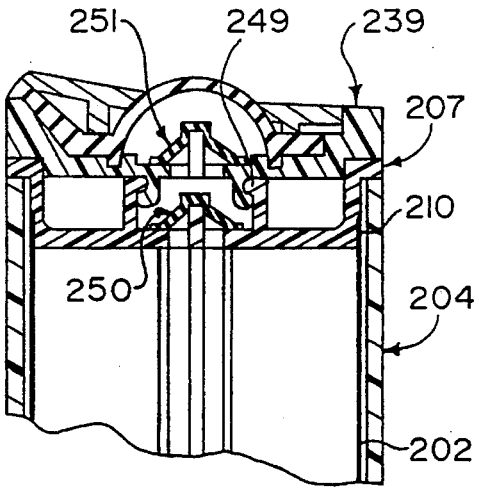
FIG. 8 is a dispenser variant according to FIG. 7.

The diaphragm pump may also include a non-return valve 251, similar to the valve 250 carried by the base: this is the variant represented in FIG. 8.

Figure 9:
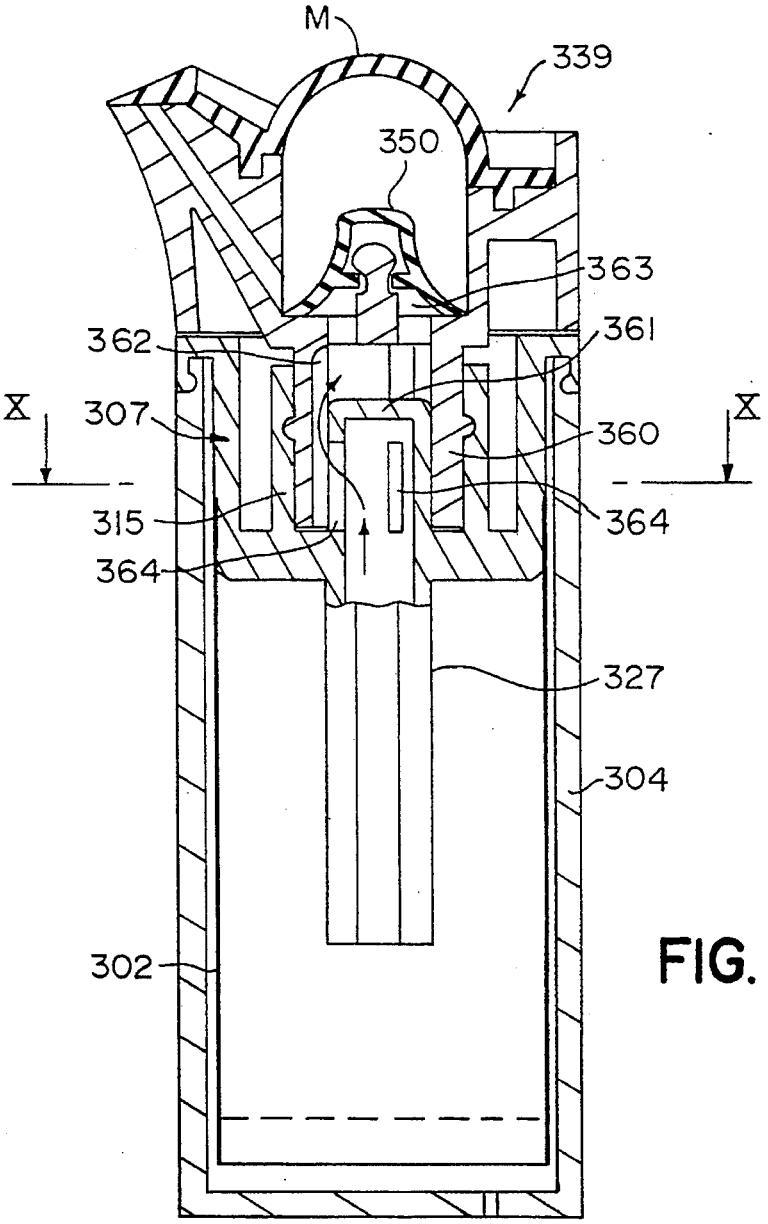
FIG. 9 is an axial section of a dispenser variant the head of which includes a member making it possible to provide opening/closing.

FIG. 9 shows another dispenser variant in which the elements which are similar to elements described previously are denoted by the same figures in the tens and units, preceded by a FIG. 3 in the hundreds. Their description will not be resumed, or will be given only succinctly.

Encountered again are a container 304, a flexible bag 302 welded onto a base 307 equipped with an anti-trapping member 327. A diaphragm pump 339, with diaphragm M is mounted on the base. The body of the pump 339 can rotate, about the axis of the container 304, between a closed position and an open position.

The body of the pump 339 includes a sleeve tube 360 which is cylindrical of revolution and coaxial with the container 304. This sleeve tube 360 is clipped, so that it can rotate about its axis, into a cylindrical of revolution spout 315 of the base 307. A hollow core 361, secured to the base 307, is engaged in the sleeve tube 360, in contact with its inner wall. The internal volume of the core 361 communicates with the bag 302.

The internal wall of the sleeve tube 360 includes longitudinal grooves 362 which are evenly spaced and extend above the core 361 to open out into a space 363 which is closed by a valve 350.

Figure 10:
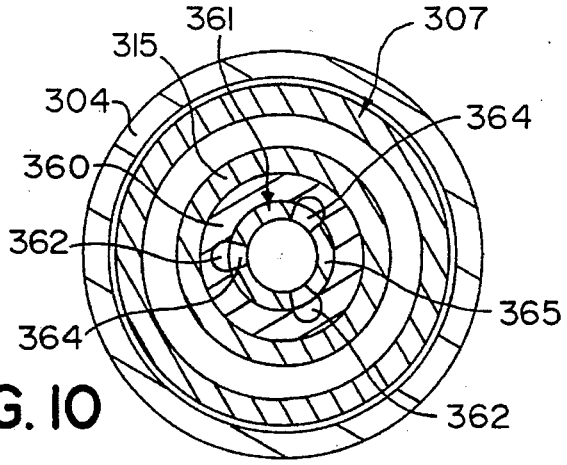
FIG. 10 is a section along the line X-X of FIG. 9, while the head is in the open position.

The cylindrical wall of the core 361 includes longitudinal apertures 364, having the same angular spacing as the grooves 362. The length of the apertures 364 is sufficient for them to be able to communicate with the grooves 362 when they occupy the same angular position. This corresponds to the open position of FIG. 10. When the diaphragm M is actuated, for pumping, the product passes through the apertures 364 and the grooves 362, as indicated by the arrow, to arrive in the space 363, negotiate the valve 350 and leave from the dispensing mouth of the pump.

Figure 11:
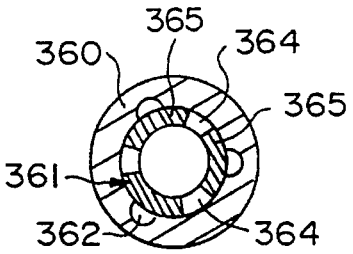
FIG. 11, finally, is a partial section similar to FIG. 10, while the head is in the closed position.

When the body of the pump 339 is rotated through a suitable angle, relative to the base 307, the bands of material 365 lying between the apertures 364 come to close the passage to the grooves 362. This closed position, illustrated in FIG. 11, makes it possible to increase the protection of the product in the bag, with respect to air, during storage between two uses.

It should be noted that the assembly of the bag and of the base may be recycled to manufacture new bases. Indeed, the mass of the bag is very small with respect to that of the base and the quantity of noncompatible material of the bag is negligible. Manufacturing rejects can therefore be reused.

I claim:

1. Liquid to pasty product dispenser comprising a container inside which is located a bag made from an easily deformable plastic compound, without an air intake, a base carrying a dispensing member being mechanically held with respect to the container, a bottom end of the bag being welded along a band, said bag being formed from a sheath obtained by welding longitudinal edges of a strip along at least one longitudinal band, the peripheral length of the cross section of the sheath being equal to the peripheral length of the base, said longitudinal band of weld intersecting said band of weld at the bottom end at a point which is remote from ends of said band of weld at the bottom end, said longitudinal band of weld welding an inner face of a longitudinal edge of the strip, from which the bag is formed, to the inner face of the other longitudinal edge of the strip located on the same side of the strip as the inner face, said base including a weld surface, and an assembly of the two longitudinal edges of the strip being folded back against an outer surface of the sheath and welded in this position by welding a top end of the bag onto the weld surface of the base, wherein the container (104) is made from a flexible memory material and is associated with a valve (137) located in such a sense that the air present in the container (104) is compressed when an action is exerted on the container for the purpose of dispensing the product contained in the bag (102).

2. Product dispenser according to claim 1 wherein the container (104) is welded onto the base (107) in line with a weld surface (136) which is located above the surface (110) via which the bag (102) is welded onto the base (107).

3. Product dispenser according to claim 1, wherein the container (104) receives, at its end opposite the one which receives the base (107), an end (105) which is secured to the container (104) by welding or bonding.

4. Liquid to pasty product dispenser comprising a container inside which is located a bag made from an easily deformable plastic compound, without an air intake, a base carrying a dispensing member being mechanically held with respect to the container, a bottom end of the bag being welded along a band, said bag being formed from a sheath obtained by welding longitudinal edges of a strip along at least one longitudinal band, the peripheral length of the cross section of the sheath being equal to the peripheral length of the base, said longitudinal band of weld intersecting said band of weld at the bottom end at a point which is remote from ends of said band of weld at the bottom end, said longitudinal band of weld welding an inner face of a longitudinal edge of the strip, from which the bag is formed, to the inner face of the other longitudinal edge of the strip located on the same side of the strip as the inner face, said base including a weld surface, and an assembly of the two longitudinal edges of the strip being folded back against an outer surface of the sheath and welded in this position by welding a top end of the bag onto the weld surface of the base, wherein a pump (339) is mounted on the base (307), and the pump body (339) can rotate about the axis of the container (64) between a closed position and an open position.

* * * * *